252-104 AU 166 EX
1/1/80 XR 4,181,621

United States Patent [19]
Raaf et al.

[11] 4,181,621
[45] Jan. 1, 1980

[54] CLEANING AGENTS FOR DENTURES

[75] Inventors: Helmut Raaf, Karlsruhe-Waldstadt; Raul L'Orange; Helmut Harth, both of Mainz, all of Fed. Rep. of Germany

[73] Assignee: Blendax-Werke R. Schneider & Co., Mainz, Fed. Rep. of Germany

[21] Appl. No.: 594,106

[22] Filed: Jul. 8, 1975

[51] Int. Cl.[2] ..... C11D 7/54
[52] U.S. Cl. ..... 252/102; 252/99; 252/100; 252/104; 424/53; 424/54
[58] Field of Search ..... 252/99, 100, 157, 102, 252/106; 424/53, 54

[56] References Cited

U.S. PATENT DOCUMENTS

| | | | |
|---|---|---|---|
| 2,576,205 | 11/1951 | Apperson | 252/99 |
| 3,167,513 | 1/1965 | van Embden et al. | 252/99 |
| 3,243,377 | 3/1966 | Stolar et al. | 252/95 X |
| 3,957,967 | 5/1976 | L'Orange | 424/54 X |

*Primary Examiner*—Mayer Weinblatt
*Attorney, Agent, or Firm*—Connolly and Hutz

[57] ABSTRACT

Disclosed is a cleaning agent for dentures, commonly in the form of powder or tablets, which is characterized by a content of at least 30% by weight urea based on the total composition. Said cleaning agent displays an improved cleaning capacity.

9 Claims, No Drawings

CLEANING AGENTS FOR DENTURES

FIELD OF THE INVENTION

The object of cleaning agents for dentures is the fastest and most complete cleaning of the artificial teeth, particularly of the plaque accumulated during wearing. The compositions currently known and available on the market unfortunately, do not accomplish this objective to the desired extent. The wearing of dentures (full or partial) which have not been entirely cleaned of plaque is not only unhygienic but may lead within a short time to considerable deterioration of the gums and eventually also of the mucous membrane of the mouth.

There exists a need, therefore, to devise a cleaning agent for dentures which effects a quick and complete cleaning of the dentures from the food particles collected during wearing and particularly from the plaque accumulated thereon.

BRIEF SUMMARY OF THE INVENTION

It has now been found that compositions for the cleaning of dentures, which contain at least 30% by weight urea based on the total composition, the remainder of the composition comprising fillers, alkaline reacting substances, complex formers, surface active agents, antimicrobial agents, enzymes, thinning agents, binding agents, aromatic and flavoring agents, as well as optionally substances separating off oxygen, exhibit the desired properties.

DETAILED DESCRIPTION OF THE INVENTION

A composition with a particularly quick and intensive cleaning capacity is obtained when the composition contains about 45% by weight or more urea. The upper weight limit is about 80% by weight urea.

The novel compositions according to the invention also preferably contain, aside from urea, a polybasic organic carboxylic acid for strengthening the cleaning force. In particular, tartaric acid is the preferred acid but citric acid, succinic acid, malic acid, fumaric acid, gluconic acid, adipic acid or mixtures therefor may also be used to advantage. The amount of polybasic organic carboxylic acid used in accord with this embodiment of the invention is about 3% to about 15% by weight of total composition. In general polybasic organic carboxylic acids which are useful have from 2 to 6 carboxylic groups and from 2 to 12 carbon atoms.

Since the consumer of powder or tablet-shaped cleaning agents for dentures expects on their dissolving in water a foaming or bubbling, there may be added to the novel denture cleaning preparation such substances which in water bring about a bubbling gas flow. This, however, is not essential in the novel preparation because, due to its high urea content, it already possesses extremely good and quick cleaing capacity. Any of the known gas releasing agents may be used and an example of such substances is an alkali metal bicarbonate, preferably sodium or potassium bicarbonate. Its proportion in the novel preparation may range from about 3% to about 25% by weight of total composition.

A particularly advantageous form of employing the denture cleaning composition of this invention, which is useful especially for dentures which have firmly adhering plaque due to a long ono-cleaning of the dentures, comprises first precleaning and loosening the plaque by immersing the dentures in a solution of the novel, urea-containing composition and thereafter carrying out a mechanical "postcleaning" by means of a gas-flow-developing preparation containing, for example, an agent separating off an alkali metal bicarbonate and/or oxygen.

This may be accomplished, for example, by encapsulating the portion of the preparation used in the second step of the cleaning process with a water-soluble film, e.g. of polyvinyl alcohol, which dissolves in cold water within a short time and releases the contents.

Although, as stated above, the addition of oxygen-separating agents to the novel preparation is possible, it is not mandatory, contrary to denture cleaning agents of customary composition. This is of advantage because of the longer stability of preparations during long storage which do not contain oxygen-releasing agents.

In the event an oxygen-separating agent, i.e. a peroxy compound, is also to be used, suitable for this purpose are the customarily employed peroxides, whose proportion is about 0.5% to about 25% by weight of the total composition. Such peroxides, for example, are the various alkali persulfates and alkali perborates such as potassium, ammonium, sodium, and lithium persulfates or perborates. However, other peroxides may also be employed, e.g. alkali carbonate peroxide, alkali pyrophosphate peroxide, alkali peroxides per se, alkaline earth peroxides, as well as organic peroxides such as urea peroxide, benzoyl peroxide or lauroyl peroxide. Mixtures of these agents may be used and per se they are of a class of oxygen-yielding agents already suggested for use in denture cleaning compositions.

As usual and known per se, the novel preparations of the present invention may also contain suitable complexing agents, such as water-soluble alkali polyphosphates, particularly sodium or potassium tripolyphosphate, alkali hexametaphosphates, tetrasodium pyrophosphate, or even organic complex constituents, e.g. nitrilotriacetic acid and the salts thereof, ethylene diaminotetracetic acid, phosphonic acids such as hydroxyethane diphosphonic acid, etc., in quantities of about 1 to about 25% by weight of the total composition.

If so desired, the novel cleaning agents for dentures may also contain one or more of the well known surface-active substances commonly used in cleaning compositions of this type whose quantitative proportion is normally not more than 5% by weight of the total composition.

Suitable surface-active agents which may be employed herein are higher alkylsulfates and the salts thereof, particularly sodium lauryl sulfate, salts of higher aliphatic acylamide of lower aliphatic aminocarboxylic acids, particularly N-lauroyl sarcosinate, N-myristoyl sarcosinate, albuminous fatty acid condensates, alkylaryl sulfonates, olefin sulfonates, and long-chain alkylsulfoacetates, quaternary ammonium compounds such as cetyltrimethyl ammonium bromide, condensates of alkylene oxides, e.g. ethylene oxide, with fatty alcohols, phenols, fatty amines or fatty acid alkanoamides, fatty acid alkanolamide per se, esters of long-chain fatty acids and polyalcohols or sugars, e.g. glycerine monostearate or saccharose monolaurate or sorbitol polyhydroxyethylene mono or distearate, betaines, sulfobetaines, long-chain alkylamino carboxylic acids and amino oxides.

To the extent that alkaline-acting substances in the form of gas-forming agents, such as alkali metal bicarbonates, are not already contained in the composition, they may be added, e.g. in the form of trialkali phosphate, alkali carbonate, etc., (such as trisodium phosphate, sodium, ammonium or potassium carbonates and the like). The novel preparations may also contain antimicrobially-acting substances. These typically may be esters of parahydroxybenzoic acid, for example, and other phenol derivatives; also the addition of 1,6-di-(4-chlorophenyl-diguanido)-hexane, which is known under the name of "chlorohexidin", and its homologs has been shown to be suitable.

The novel cleaning agents for dentures may be colored and for this purpose may contain water-soluble coloring substances, which may also serve as time indicators, becoming colorless upon a completed cleaning. Examples of such coloring matter are FDC blue 02, DC red 010, FDC green 01 and 02 or FDC violet 01, all of which are introduced in small concentrations. If the novel agent is to be employed in the form of a tablet, it should contain the customary binding agents, e.g. polyvinyl pyrrolidone.

The novel preparations will usually contain flavoring and aromatic substances; added, furthermore, may be fillers, buffering substances, enzymes, which accelerate the decomposition of food residues and plaque, e.g. proteases, carbohydrases or lipases.

In other words, in addition to urea in the amounts specified and the polybasic organic carboxylic acids when desired, the denture cleaning agents of the present invention may contain other ingredients commonly found in such compositions whose identity and function are well known—See U.S. Pat. Nos. 2,498,344, 3,114,111, 3,337,466, 3,372,125 and 3,640,879.

Given below are several examples of compositions made according to the present invention. The figures given in this connection refer to percent by weight.

EXAMPLE I

| Denture Cleaning Powder | |
|---|---|
| Ingredients | Percent by Weight |
| (a) urea | 78.0 |
| sodium tripolyphosphate | 20.0 |
| Aerosil(R) (finely divided $SiO_2$) | 0.5 |
| Sodium lauryl sulfate | 0.3 |
| peppermint oil menthol | 0.5 |
| saccharine sodium | 0.1 |
| sodium benzoate | 0.6 |
| | 100.0 |
| (b) urea | 35.0 |
| sodium sulfate | 10.0 |
| tartaric acid | 6.0 |
| sodium carbonate | 9.0 |
| sodium bicarbonate | 17.2 |
| sodium tripolyphosphate | 15.0 |
| silicic acid, amorphous | 0.5 |
| potassium monopersulfate | 5.0 |
| aroma | 0.8 |
| sodium lauroyl sarcosinate | 1.5 |
| | 100.0 |

EXAMPLE II

| Denture-Cleaning Tablets | |
|---|---|
| Ingredients | Percent by Weight |
| (a) urea | 54.0 |
| citric acid | 8.3 |
| sodium bicarbonate | 12.0 |

-continued

| Denture-Cleaning Tablets | |
|---|---|
| Ingredients | Percent by Weight |
| polyethylene glycol 4000 | 2.5 |
| carboxymethylcellulose | 0.7 |
| trisodium phosphate | 15.5 |
| coconut monoglyceride sulfonate | 1.0 |
| polyvinyl pyrrolidone | 5.5 |
| aroma | 0.4 |
| sweetener | 0.1 |
| | 100.0 |
| (b) urea | 67.0 |
| potassium sodium tripolyphosphate | 18.5 |
| sodium lauryl sulfate | 1.6 |
| aroma-Aerosil mixture | 2.5 |
| polyvinyl pyrrolidone | 6.0 |
| polyethylene glycol 6000 | 2.7 |
| starch, phosphated | 1.5 |
| alkyldimethylbenzylammonium bromide | 0.2 |
| | 100.0 |
| (c) urea | 55.0 |
| tartaric acid | 10.0 |
| sodium tripolyphosphate | 18.5 |
| polyethylene glycol 6000 | 4.5 |
| polyvinyl pyrrolidone | 7.5 |
| sodium lauryl sulfate | 1.5 |
| sodium benzoate | 1.0 |
| aroma-Aerosil(R) | 2.0 |
| | 100.0 |

Throughout the specification and claims, the term "denture" means a dental prosthetic device including artificial teeth, removable orthodontic briges and denture plates of both upper and lower types, full or partial.

What we claim is:

1. A denture cleaning composition suitable for cleaning dentures consisting essentially of at least 30 percent by weight of the total composition of urea and at least one member selected from the group consisting of a surface active agent, a flavoring agent, a filler, a complexing agent, a binding agent and an antimicrobial agent.

2. The cleaning composition according to claim 1 wherein the urea is present in an amount of from about 45 to 80 percent by weight of the total composition.

3. The cleaning composition according to claim 1 wherein there is additionally present from about 3 to about 15 percent by weight of the total composition of a polybasic organic carboxylic acid having from 2 to 12 carbon atoms and from 2 to 6 carboxylic acid groups.

4. The cleaning composition according to claim 3 wherein the organic acid is a member selected from the group consisting of tartaric acid, citric acid, adipic acid, succinic acid, malic acid, fumaric acid, gluconic acid and mixtures thereof.

5. The cleaning composition according to claim 1 containing 1 to 25 percent by weight of the total composition of an oxygen-releasing agent or a carbon dioxide releasing agent selected from the group consisting of alkali metal carbonates and alkali metal bicarbonates.

6. The cleaning composition according to claim 5 containing at least one member selected from the group consisting of enzymes which accelerate the decomposition of food residues and buffering agents.

7. A method of cleaning dentures which comprises contacting said dentures with an aqueous solution of a cleaning composition according to claim 1 for a time at least sufficient to loosen plaque adhered to the dentures.

8. The method according to claim 7 wherein the cleaning composition consists essentially of from about 45 to 80 percent by weight urea, about 3 to 15 percent by weight of a member selected from the group consisting of tartaric acid, citric acid, adipic acid, succinic acid, malic acid, fumaric acid, gluconic acid and mixtures thereof, from about 1 to 25 percent by weight of a surface active agent, an oxygen-releasing agent, a filler, a binding agent and an agent for forming carbon dioxide selected from the group consisting of alkali metal carbonates and alkali metal bicarbonates.

9. The process according to claim 7 wherein after contact with the cleaning composition according to claim 1 the denture is contacted with a second cleaning agent containing an oxygen-releasing agent or a carbon dioxide releasing agent selected from the group consisting of alkali metal carbonates and alkali metal bicarbonates.

* * * * *